US010190728B2

(12) United States Patent
Schmidt et al.

(10) Patent No.: US 10,190,728 B2
(45) Date of Patent: Jan. 29, 2019

(54) LAMP WITH OPTOELECTRONIC LIGHT SOURCE AND IMPROVED ISOTROPY OF THE RADIATION

(71) Applicant: OSRAM GmbH, München (DE)

(72) Inventors: Tobias Schmidt, Augsburg (DE); Christopher Wiesmann, Fürstenfeldbruck (DE); Stephan Malkmus, Puchheim (DE)

(73) Assignee: LEDVANCE GMBH, Garching Bei München (DE)

( * ) Notice: Subject to any disclaimer, the term of this patent is extended or adjusted under 35 U.S.C. 154(b) by 0 days.

(21) Appl. No.: 15/106,178

(22) PCT Filed: Nov. 26, 2014

(86) PCT No.: PCT/EP2014/075629

§ 371 (c)(1),
(2) Date: Jun. 17, 2016

(87) PCT Pub. No.: WO2015/090867

PCT Pub. Date: Jun. 25, 2015

(65) Prior Publication Data

US 2016/0319998 A1 Nov. 3, 2016

(30) Foreign Application Priority Data

Dec. 18, 2013 (DE) ..... 10 2013 226 462

(51) Int. Cl.

| | |
|---|---|
| ***F21V 23/04*** | (2006.01) |
| ***F21K 9/232*** | (2016.01) |
| ***F21V 3/04*** | (2018.01) |
| ***F21V 7/04*** | (2006.01) |
| ***F21K 9/23*** | (2016.01) |
| ***F21V 29/77*** | (2015.01) |
| ***F21K 9/66*** | (2016.01) |

(Continued)

(52) U.S. Cl.

CPC ..... *F21K 9/232* (2016.08); *F21K 9/23* (2016.08); *F21K 9/66* (2016.08); *F21K 9/68* (2016.08); *F21V 3/02* (2013.01); *F21V 3/049* (2013.01); *F21V 7/041* (2013.01); *F21V 7/22* (2013.01); *F21V 29/777* (2015.01); *F21Y 2105/10* (2016.08); *F21Y 2115/10* (2016.08)

(58) Field of Classification Search

CPC ..... F21K 9/238; F21K 9/23; F21V 23/006
See application file for complete search history.

(56) References Cited

U.S. PATENT DOCUMENTS

| | | | | |
|---|---|---|---|---|
| 4,459,642 | A | 7/1984 | Mori | |
| 2010/0002432 | A1* | 1/2010 | Romano | F21S 48/328 362/235 |

(Continued)

FOREIGN PATENT DOCUMENTS

| | | | |
|---|---|---|---|
| JP | 2010157459 | A | 7/2010 |
| JP | 2013145681 | A | 7/2013 |
| WO | 2013036061 | A1 | 3/2013 |

OTHER PUBLICATIONS

PCT International Search Report for PCT/EP2014/075629 dated Nov. 24, 2014.

*Primary Examiner* — Evan Dzierzynski
(74) *Attorney, Agent, or Firm* — Hayes Soloway PC

(57) ABSTRACT

The invention relates to an optoelectronic lamp with improved omni-directionality by using a reflector cap having an opening.

13 Claims, 10 Drawing Sheets

(51) Int. Cl.

| | |
|---|---|
| ***F21K 9/68*** | (2016.01) |
| ***F21V 3/02*** | (2006.01) |
| ***F21V 7/22*** | (2018.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 2010/0290223 | A1* | 11/2010 | Wei | F21V 3/00 362/235 |
| 2011/0261563 | A1 | 10/2011 | Li | |
| 2012/0026740 | A1 | 2/2012 | Kim et al. | |
| 2012/0250305 | A1* | 10/2012 | Shimizu | F21V 3/0481 362/231 |
| 2013/0120983 | A1 | 5/2013 | Tsai | |
| 2013/0148350 | A1 | 6/2013 | Yriberri et al. | |

* cited by examiner

LAMP WITH OPTOELECTRONIC LIGHT SOURCE AND IMPROVED ISOTROPY OF THE RADIATION

CROSS-REFERENCE TO RELATED PATENT APPLICATIONS

This application is a 35 U.S.C. § 371 National Stage filing of International Application No. PCT/EP2014/075629, filed on Nov. 26, 2014, which claims priority to German Patent Application No. DE 10 2013 226 462.3 filed on Dec. 18, 2013, the content of each application is hereby incorporated by reference in its entirety.

TECHNICAL FIELD

The present invention relates to a lamp with an optoelectronic light source.

Optoelectronic light sources, in particular LEDs have rapidly gained in importance in the lighting industry over the last few years and with regard to energy efficiency, durability, switching endurance and other properties, show great advantages.

However, a typical optoelectronic light source, for example, an LED chip naturally has an anisotropic light radiation distribution wherein in a main radiation direction, for example, perpendicular to a chip plane, the radiation is strongest and, with increasing angle thereto, becomes ever weaker. In many uses, this is unproblematic or even desired, but in other uses, it is disadvantageous. Above all, on use of optoelectronic light sources for the replacement of traditional lamps such as incandescent lamps or energy-saving lamps (that is, compact low-pressure discharge lamps) for general illumination or interior illumination, isotropically radiating lamps are largely desired. In this regard, the "omnidirectionality" of a lamp is referred to. For example, a previously existing luminaire can be configured to the radiation emission characteristics of a conventional lamp or if, for reasons of space or economy, an additional cost for reflectors, diffusers of lenses belonging to the luminaire is to be spared.

Above all in the field of "retrofit" lamps, that is, the aforementioned optoelectronic successor solutions for conventional lamps, different technologies which provide help by means of complex-shaped lens bodies and are intended to improve the omnidirectionality have been proposed in use or in the patent literature. In this regard, there are also different standards, for example, the "Energy Star" standard, with certain minimum requirements on the omnidirectionality, wherein such standards are subject to temporal changes and should be understood herein only as examples and in no way restrictive.

In a narrower sense, a "lamp" denotes the illuminant and for the whole illumination device into which the lamp is inserted, the word "luminaire" is used. However, since particularly with regard to the optoelectronic light sources, the boundaries between lamps and luminaires are blurred, in the following, the expression "lamp" is used for an illuminant, but also for a luminaire with an illuminant, wherein the question of the separate removability of the illuminant is not of primary importance. Furthermore, in the following, it is the isotropy of a "lamp" that is dealt with, but without this meaning a difference in content from "omnidirectionality". In particular, for a good "lamp", isotropic conditions in the mathematical sense are certainly not necessary.

SUMMARY

It is an object of the invention to provide a pragmatic and simple possibility for improving the radiation isotropy of a lamp with an optoelectronic light source.

This object is achieved by means of a lamp with an optoelectronic light source which has an anisotropic light radiation with a main radiation direction, the radiated light intensity decreasing with increasing aperture angle relative to the main radiation direction, a reflector cap for reflection of light of the light source radiated into the solid angle, so that the angle of the propagation direction of the reflected light to the main radiation direction increases, said reflector cap more strongly reflects than transmits incident light of the light source, with an opening in the reflector cap and with a diffuser for scattering light passing through the opening, the reflector cap being present in a region of greater aperture angle relative to the main radiation direction and the light source than the opening, so that light reflected by the reflector cap is reflected out of a radiation direction with relatively more intense light radiation into a direction in which the light source radiates light relatively more weakly, and a shadow effect of the reflector cap in the radiation direction with the more intense light radiation is lessened as a result of the opening and the diffuse scattering of the light passing through the opening.

According to the invention, a reflector cap is provided which serves, expressed generally, for "brightening" solid angle regions or radiation directions which receive relatively less light with regard to the light radiation distribution of the optoelectronic light source per se. For this purpose, the light is reflected relative to the main radiation direction of the light source at greater angles, that is more intensely laterally from the main radiation direction and/or even "backwardly", that is, into the half-space opposite to the main radiation direction. In an individual case, this depends thereon into which solid angle the lamp is to radiate overall; the invention relates also, even though less preferably, to lamps with an overall radiation only into the "forward" half-space.

The reflector cap need not necessarily be a pure reflector; rather it can be somewhat transmissive. However, it should reflect more intensely than transmit in the context of the invention, wherein the reflectivity is preferably at least twice as great or even at least five times as great or ten times as great as the transmissivity. Preferably, the reflector cap is diffusely reflective in order not to generate excessively great unevennesses in the brightened regions.

On the other hand, the diffuser can in principle also have a significant reflectivity, although according to the invention, it should transmit more intensely than reflect wherein the transmissivity is preferably at least twice as great or even at least five times as great or ten times as great as the reflectivity. The statements regarding the transmissivity and reflectivity of the reflector cap and of the diffuser relate to a perpendicular light incidence and to visible light on average.

In general, the reflector cap and the diffuser do not necessarily have to be configured homogeneously, but can, for example, have a microstructure or a heterogeneous pattern. The statements made here concerning the transmissivity and the reflectivity relate to useful local averages. In the particular normal user spacing, patterns and microstructures have no essential role. Preferably, the individual patterns or microstructures have typical (one-dimensional, that is, related to length or width) dimensions below the dimensions of the light-radiating surface of the light source. This can be, for example, the light-radiating surface of the LED, a fluorescent layer applied directly to the LED or a fluorescent layer somewhat removed therefrom. The background to this criterion is that the light-radiating surface should not be visible through the individual patterns. With regard to a diffuser, it could be stated more generally that the light-radiating surface, seen from a typical distance of a user, that is with a negligible difference between the distances of the pattern from the observer and of the light-radiating surface from the observer should effectively back-light a plurality of individual structures and not only (direction-dependently) exactly one and only this one individual region appearing somewhat brighter or somewhat darker.

Further, the reflector cap has an opening wherein the reflector cap should be present at least also in a larger aperture angle region (here and below, always relative to the main radiation direction and to the light source as the origin) than the opening. In other words, the opening is situated, with regard to aperture angles, closer to the main radiation direction than at least substantial parts of the reflector cap. Regarding the question of further reflector cap parts for which this statement does not apply in particular embodiments, reference is made to the description below.

The reflector cap can thus deflect light of the light source into regions to be brightened and thus contribute to the better overall distribution. By means of the opening in the reflector cap, excessive shading in the directions covered by the reflector cap can also be attenuated or even prevented. Herein, according to the invention, a diffuser is provided which diffusely scatters at least light emerging through the opening. Due to this scattering, light is deflected out of the solid angle region covered by the opening into the solid angle regions masked by the reflector cap and lessens the shading effect. Furthermore, due to the diffuse scattering, too great a brightness in the solid angle regions covered by the opening can be prevented. If no opening were present, then for this purpose, light from regions lying at greater aperture angles would have to be used, which however, according to the object of this invention, should be more intensely supplied with light and not weakened.

Furthermore, with the invention, a region otherwise shaded, for example, by a holder can be brightened, thus the whole solid angle into which the lamp radiates can be increased. Since an LED chip is typically configured flat and is mounted on such a holder, the aspect of shading in the half-space opposite to the main radiation direction often plays a large part.

The invention thus permits with a very simple basic structure, specifically a reflector with an opening and a diffuser, a practical, but nevertheless effective improvement of the isotropic light radiation in optoelectronic lamps.

The reflector cap also permits, if needed, and depending on the case of use, a visual covering of lamp regions which could worsen the appearance, for example a visual covering of the LED chip or, for example, yellow fluorescent surfaces. In the prior art, the approach is also used of, for example, creating good isotropy by means of a large-area and, for example, spherical fluorescent material distribution on a bulb round the light source. This can have the disadvantage, inter alia, that the fluorescent material is yellow due to the desired colour temperature and therefore the lamp is unsightly.

However, it can also be advantageous to prevent direct dazzling in that the direct gaze into the light source is blocked, in particular by the reflector cap, but also by the diffuser.

In a preferred embodiment, the lamp has a bulb which surrounds the light source in a desired (typically) large solid angle. This bulb can then be configured at least partially as a diffuser, for example, simply a roughened wall of otherwise almost or totally transparent material. The bulb is herein not necessarily the outermost bulb of the lamp, thus for example, it is not necessarily the bulb of a retrofit fluorescent material that the user touches during handling, but can also be arranged within an additional such bulb. Preferably, the whole of the bulb considered here is configured translucently scattering which, however, in the case of a distinctly preferred integrated embodiment of the reflector lamp with the bulb need not apply for the regions corresponding to the reflector cap—see above.

The diffuse scattering in the diffuser and preferably also in the remaining diffusely scattering region of a possible bulb can have an FWHM angle (Full Width Half Maximum, that is, the full opening width up to the halving of the maximum intensity of the scattered light) of between 10° and 100°, wherein as the lower limit of this region 15°, 20° and 25° and conversely as the upper limit 90°, 80° and 70° are respectively preferred.

The reflector cap need not necessarily surround the main radiation direction with a (relating to a rotation thereabout) closed surface, however, it should preferably cover at least 75% (in relation to the rotation angle about the main radiation direction), wherein as the lower limit, the values of 80%, 85%, 90% and 95% are increasingly preferred and consequently a closed area of the reflector cap round the main radiation direction (which need not necessarily be restricted to this area) is particularly preferred. In particular, the reflector cap can be rotationally symmetrical about the main radiation direction, specifically preferably relative to an at least two-fold, three-fold, four-fold or even at least eight-fold symmetry. The exemplary embodiment shows the particularly preferred case of a rotational symmetry relative to an arbitrary rotation angle.

The expression "opening" thus does not necessarily imply that the reflector cap must be closed round the opening. The expression "opening" has already been introduced in the context that it is present in a region of a smaller aperture angle relative to the main radiation direction than the, or a part of the, reflector cap, so that the opening can serve to brighten a shading effect of the reflector cap. These statements are also fulfilled in principle when, for example, the reflector cap has an incompletely closed ring form or is partially interrupted in another way. Subject to the above statements on the closedness of the reflector cap and on the rotational symmetry, the statements on the reflector cap and on the opening therefore relate to the primary reflection or the primary transmission at particular aperture angles.

The above statements on the rotational symmetry preferably also apply for the bulb, specifically independently of the symmetry of the reflector cap, wherein however, the same respective symmetry is preferably present.

In principle, the transitions between the reflector cap and adjacent regions (for example, if the reflector cap is substantially a coating on a bulb or a diffuser) can also be smooth, which contributes, in principle, to the evenness of the light distribution. However, in this invention, as the exemplary embodiment shows, a pre-simulation of the light distribution is useful and preferable. For this purpose, sharp limits of the reflector cap are easier to manage and the necessary "softness" of the light distribution can also be generated by the diffuser and possibly other diffusely scattering regions outside the opening. The manufacturing of the lamp itself is also often simpler with sharp borders. For similar reasons, a homogeneous configuration of the reflector cap and the diffuser is also advantageous (see above).

The reflector cap can be "concave" from the view of the light source, whereas for this reason, it does not have to be spherical or curved. What is meant, rather, is that regions of the reflector cap closer to the main radiation direction have a greater separation from the light source than regions further from the main radiation direction with the correspondingly greater aperture angle, with regard to a plane through the light source (perpendicular to the main radiation direction). The experiments of the inventors have revealed that with such straight or curved "concave" geometries, in principle, the desired brightening can be created just as well as with "convex" geometries, but that the concave geometries are typically easier to integrate spatially. This concerns both an independent physical configuration of the reflector cap as well as its realisation as a layer on another component.

It was indicated previously that the reflector cap can also have at least one further part beyond the part which is present at larger aperture angles than the opening in the reflector cap. In particular, a further reflector cap part can be provided in the opening, specifically so that it covers the main radiation direction. Herein, the same statements apply in principle regarding rotational symmetry as before. If, for simplification, an entirely rotationally symmetrical configuration is assumed, then (excepting an arch, angulation or the like) at small aperture angles, a circular disk-shaped reflector cap is present in the projection onto a plane perpendicular to the main radiation direction, a ring-shaped opening adjacent thereto and, at still larger aperture angles, a second ring-shaped reflector cap (or a second part of the reflector cap) adjacent to the opening. Herein, reference is made to the exemplary embodiment.

In principle therefore, in this example, the opening in the projection mentioned is ring-shaped. In principle, also, a further such opening ring can be provided; just as effectively, however, a further opening can be provided at the small aperture angles in the reflector cap, so far described as circular disk-shaped, for example, directly in the main radiation direction. The experiments by the inventors have revealed, however, that the desired simulations become ever more involved with increasing complexity of the geometry and do not necessarily entail an improvement in the results. It has been found, in particular, that the two-part reflector cap already described with an opening lying between two reflector cap parts (in the symmetrical case, circular ring-shaped in the projection) is a very good compromise with regard to complexity or number of parameters and the results achieved. It is somewhat more complex than a variant with a one-part reflector cap and an opening round the main radiation direction, but it also gives better results.

The reflector cap can be applied in a favourable manner on a wall of the bulb, preferably as a coating. However, it can also be held on such a wall as a physically separate part. Furthermore, the reflector cap is preferably arranged outside a bulb wall, which in the case, for example, of a coating of the bulb wall means a coating from outside and otherwise can mean, for example, an arrangement between said bulb and another lying further outwardly.

In the simplest and preferred case, the reflector cap is provided herein and independently thereof with a diffusely reflective layer, for example, of titanium oxide or similar material and does not permit any transmission, either due to the sufficient thickness of this layer or due to additional components.

The possibility of a second bulb outside that previously mentioned has already been briefly considered. The second bulb can herein also be configured diffusely scattering; in many cases, however, it is preferred for cost reasons not to provide any double diffuser solution and, for example, to configure only the inner bulb diffusely scattering. Then, the outer bulb can be a clear transparent bulb. Naturally, it can also assume the diffuser role in place of the inner bulb. In each case, it is preferably spaced from the reflector cap.

Finally, the reflector cap can also be configured as part of a cooling device and designed, for example, metallic or otherwise heat-conducting and can be connected via heat-conducting elements to a holder at the light source. For example, cooling ribs can extend between the reflector cap and the holder, configured as far as possible "radially" to the main radiation direction to minimise a shading effect and can transport heat away from the light source, radiate heat themselves and pass it on to the also radiating reflector cap.

The invention will now be described in greater detail by reference to exemplary embodiments, the features of which can also be essential to the invention in other combinations.

DETAILED DESCRIPTION

Figure 1:
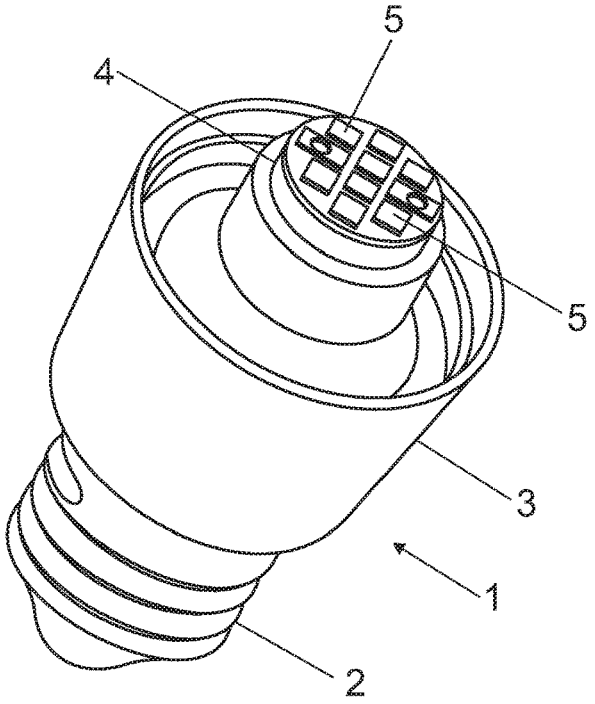
FIG. 1 shows a lamp according to the invention in accordance with a first exemplary embodiment.

FIG. 1 shows a per se conventional holder 1 of an optoelectronic lamp. This lamp is a "retrofit" lamp, that is, an LED light source as a technological upgrade model for a conventional incandescent lamp or low pressure discharge lamp with a screw cap. In this respect, the holder 1 has a downwardly facing screw cap 2 for a commonly used connecting thread. On the opposite side is a truncated conical lateral surface 3 in which an electronic driving device for the LEDs (described later) is contained. This lateral surface opens in FIG. 1 toward the top right into a collar in which a bulb 6 (not shown in FIG. 1) can be held. Provided within the collar is a radially (relative to the circular form of the collar) significantly smaller front plate 4 on which an assembly of a plurality of LEDs 5 (a "light kernel") is mounted. The LEDs 5 can have different colours in this plurality in order to generate an overall mixed colour, for example, warm white; they can also each radiate white light and be combined purely to generate a desired overall power. These circumstances are common knowledge to a person skilled in the art.

Due to their structure, the LEDs radiate light anisotropically, specifically most strongly perpendicularly to their main surface, that is, perpendicularly to the front surface of the front plate 4. With increasing angle to this main radiation direction, the light intensity decreases very markedly. In the rearward half-space, from the perspective of the LEDs, they can radiate no light at all.

Figure 2:
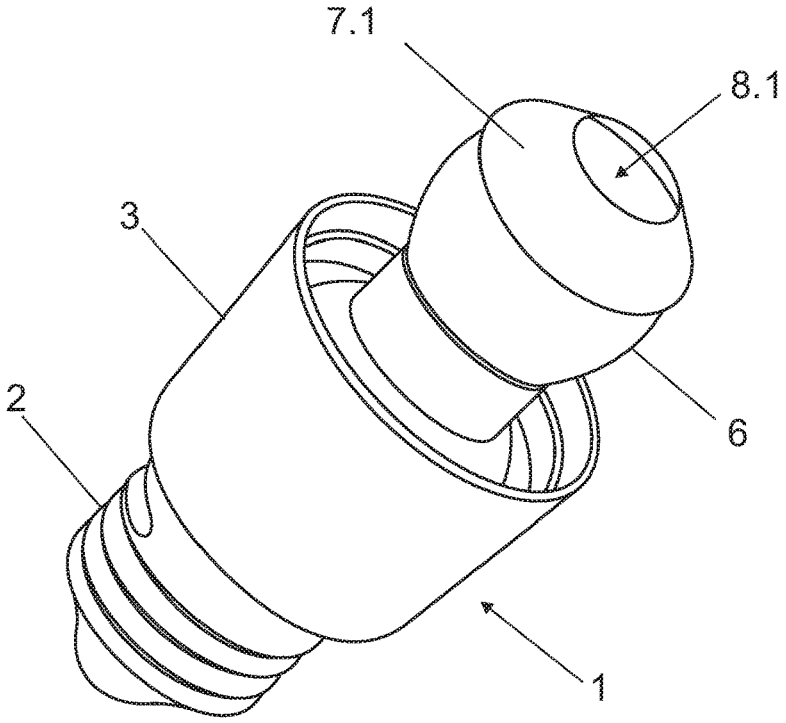
FIG. 2 shows the lamp of the first exemplary embodiment without a bulb.

FIG. 2 shows the same lamp holder 1, wherein an approximately spherical bulb 6 with translucent and thus diffusely scattering walls is provided round the front plate 4. It is mounted in a circular region round the front plate 4 which is radially smaller than the collar mentioned in relation to FIG. 1; this bulb belonging to the latter-mentioned collar will be considered below. FIG. 2 also shows a reflector cap 7.1 which here consists of a truncated conical surface, that is, effectively a conically tilted ring-shape. This reflector cap 7.1 reflects light of the LEDs into the rear half-space, that is, in relation to FIG. 2 from the viewpoint of the reflector cap 7.1, past the proximal edge of the lateral surface 3 and thereby also brightens the regions of the front half-space which have relatively large angles to the main radiation direction.

Figure 3:
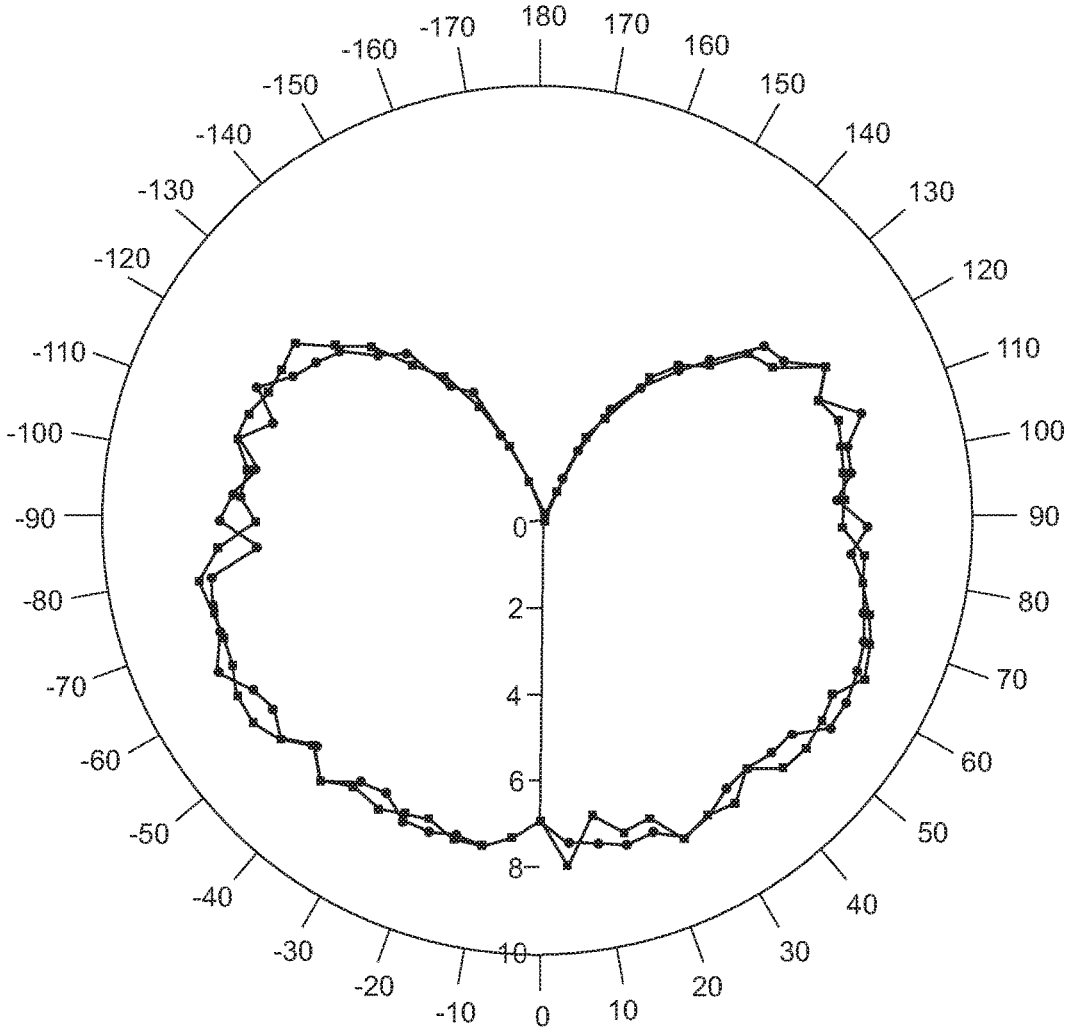
FIG. 3 shows a polar diagram of light intensity distribution of the first exemplary embodiment.
Figure 4:
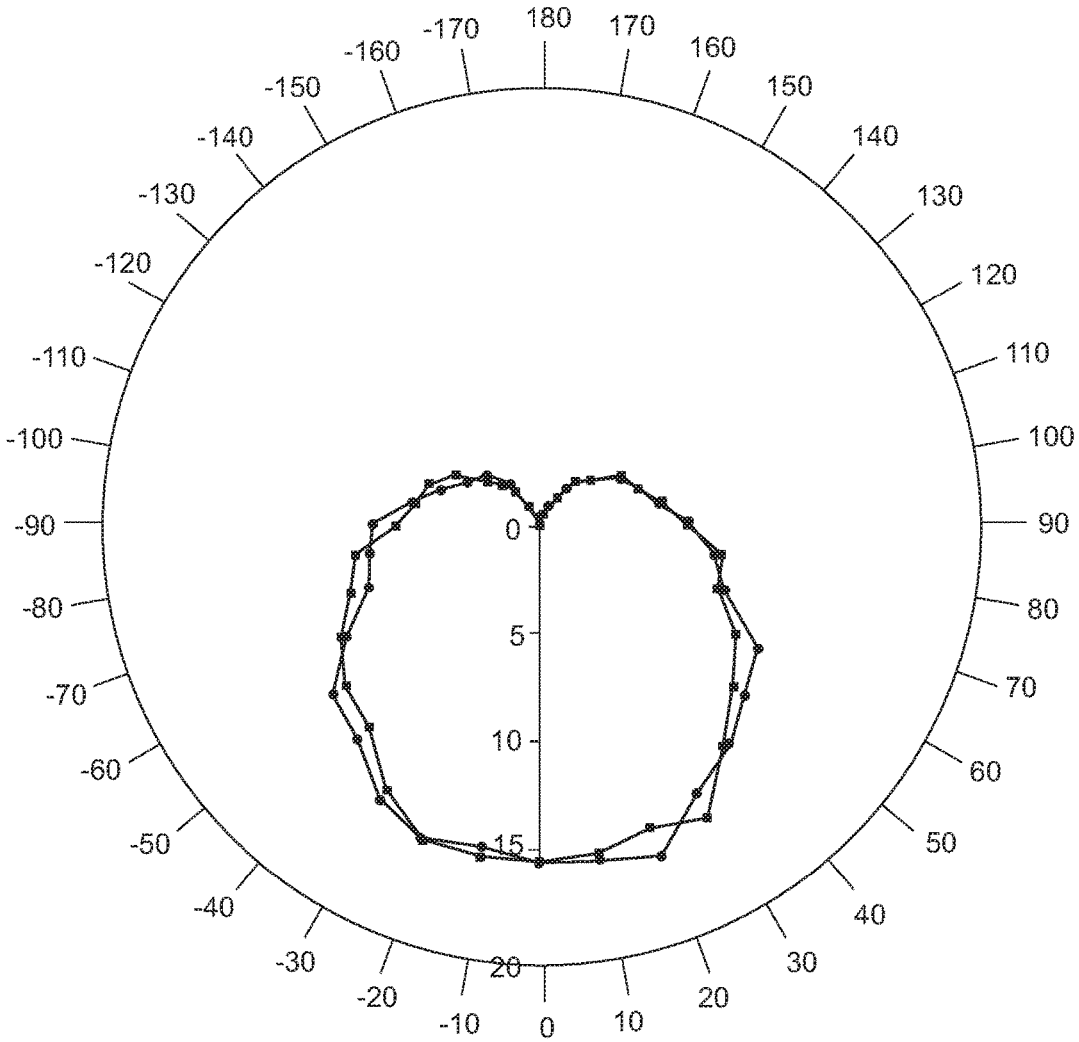
FIG. 4 shows a polar diagram for comparison with a variant without a reflector cap.

This is apparent in a comparison of the two diagrams in FIGS. 3 and 4. FIG. 3 shows a polar diagram with the light intensity distribution as a function of angle. It should be noted that the main radiation direction here faces from the centre of the circular diagram downwardly, wherein the radial separation from the centre of the diagram symbolises the light intensity. The upward direction would therefore face directly backwardly from the LEDs through the middle of the holder in FIG. 2 and is naturally dark.

The diagram of FIG. 3 should be compared with that of FIG. 4, which shows the same structure without the reflector cap 7.1. Taking note of the units, it is readily observed that the variant of FIG. 4 shines much more intensely in the main radiation direction (with an amplitude of 15 units as compared with nearly 8 in FIG. 3), but that the variant in FIG. 3 covers the sides and a part of the rear half-space more strongly. The diffusely scattering bulb 6 alone thus causes an improvement and, in particular, also a slight radiation into the rear half-space; the variant with the reflector cap 7.1 is significantly better herein. (In FIGS. 3 and 4, the shading by the holder 1 is not taken into account, rather only the light intensity distribution on the basis of the characteristic of the LEDs and the diffuse properties of the bulb 6 as well as the reflection and due to the reflector cap 7.1 are taken into account.)

The reflector cap 7.1 can be, for example, a thin sheet metal cap or a cap made of a thin and sufficiently heat-resistant plastics material which is coated at least inwardly with a highly reflective, as far as possible soft material, for example a reflector material containing titanium oxide. The bulb has scattering properties which can be described as an FWHM angle of approximately 35 to 40 degrees. The previously-described ring structure of the reflector cap has an opening 8.1 which in FIG. 2 contains the main radiation direction in relation to the middle of the LED arrangement, and has approximately a total aperture angle of 45 degrees; the reflector cap then covers the intermediate region between this aperture angle and an aperture angle of approximately 85 degrees.

A core proposal of this invention is that an opening in the reflector cap (also in another form, see introduction to the description) significantly improves the light intensity distribution reproduced in FIG. 3, since the reflector cap 7.1 as such without an opening would shade too strongly forwardly. Furthermore, the diffuse scattering at least of the light passing through the opening is of great advantage in order to configure the light intensity distribution according to FIG. 3 "smoothly". In this example, the remaining light of the LEDs is also captured by the diffuse bulb 6, which is also advantageous.

Furthermore, it has been found that the improved isotropy of FIG. 3 as compared with FIG. 4 must be obtained at the cost of a somewhat worsened efficiency or a worsened lumen value relative to the electrical power used, although this—without the reflector cap 7.1—in order to improve the isotropy of more strongly diffusely scattering properties of the bulb would have the consequence of a more marked efficiency worsening.

Figure 5:
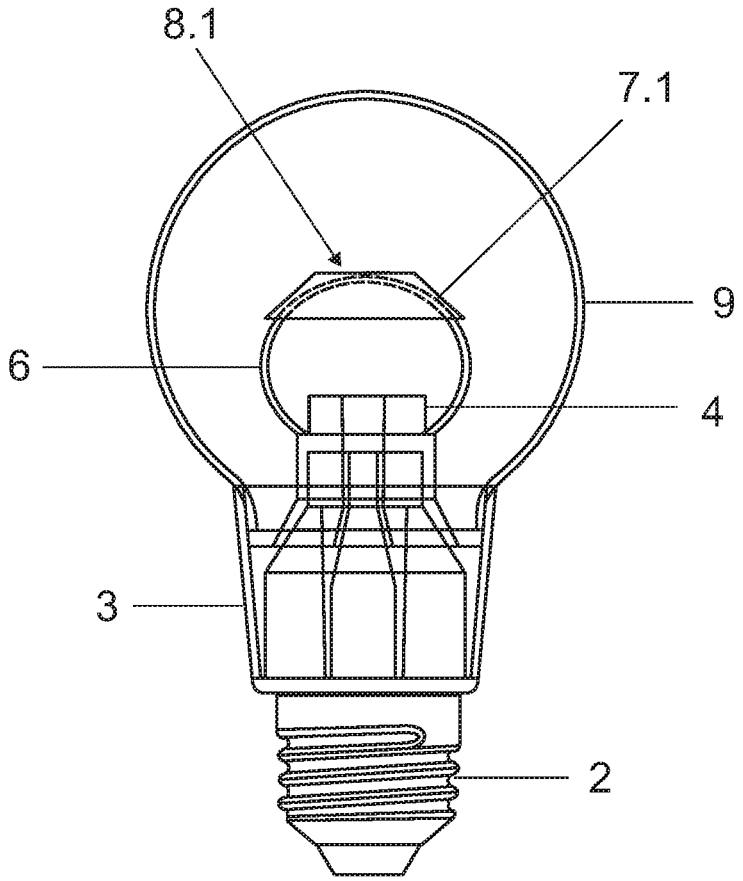
FIG. 5 shows a lamp in accordance with a second exemplary embodiment in section.

FIG. 5 shows a longitudinal section through the complete lamp according to FIGS. 1 to 4 wherein, as distinct therefrom, a further outer bulb 9 of transparent material, for example, glass has been placed in the previously described ring-shaped collar of the lateral surface 3. This outer bulb 9 has no significant influence on the light intensity distribution; however, it could also be configured somewhat diffusely scattering, if desired. In particular, the desired diffuse scattering could be distributed between the inner bulb 6 and the outer bulb 9, although this increases the cost. In many cases, however, clear bulbs 9 are desired. If, however, a diffuse outer bulb 9 is desired, perhaps in order to hide the technical interior workings, then the inner bulb could be transparent or omitted.

Figure 6:
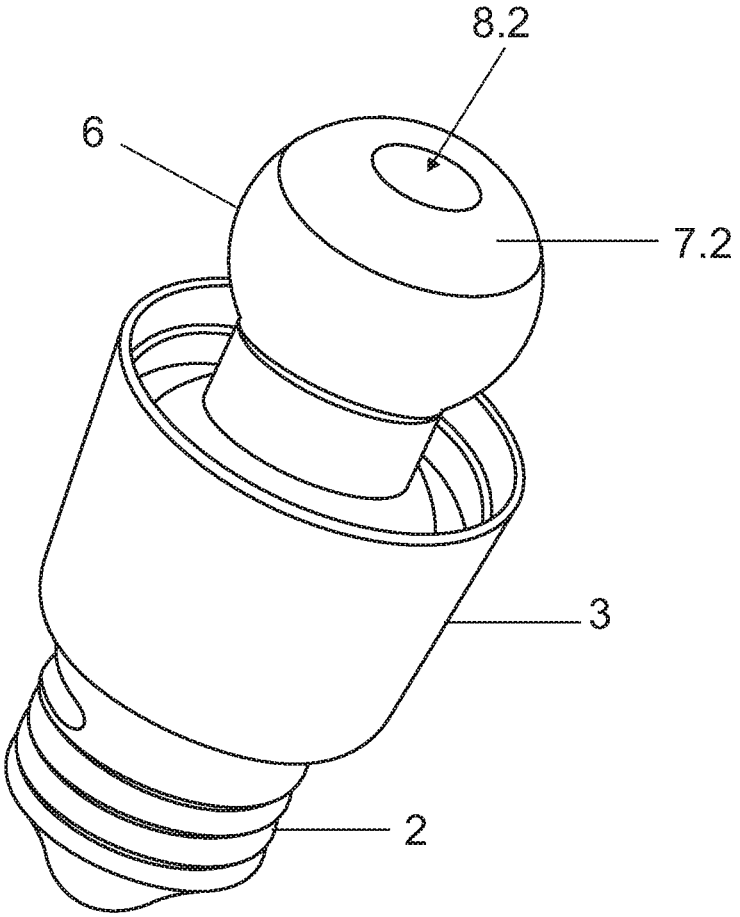
FIG. 6 shows a representation corresponding to FIG. 2 of a second exemplary embodiment.

FIG. 6 shows a second exemplary embodiment based on FIG. 2. Herein, the outer cap is configured as a coating on the outside of the otherwise unchanged inner bulb 6 and is identified as 7.2. The reflector cap 7.2 thus follows the shape of the inner bulb 6. The corresponding opening is identified here as 8.2. The associated light intensity distribution is very similar to that of FIG. 3 and the corresponding finished lamp, apart from the embodiment of the reflector cap, is similar to that in FIG. 5.

Figure 7:
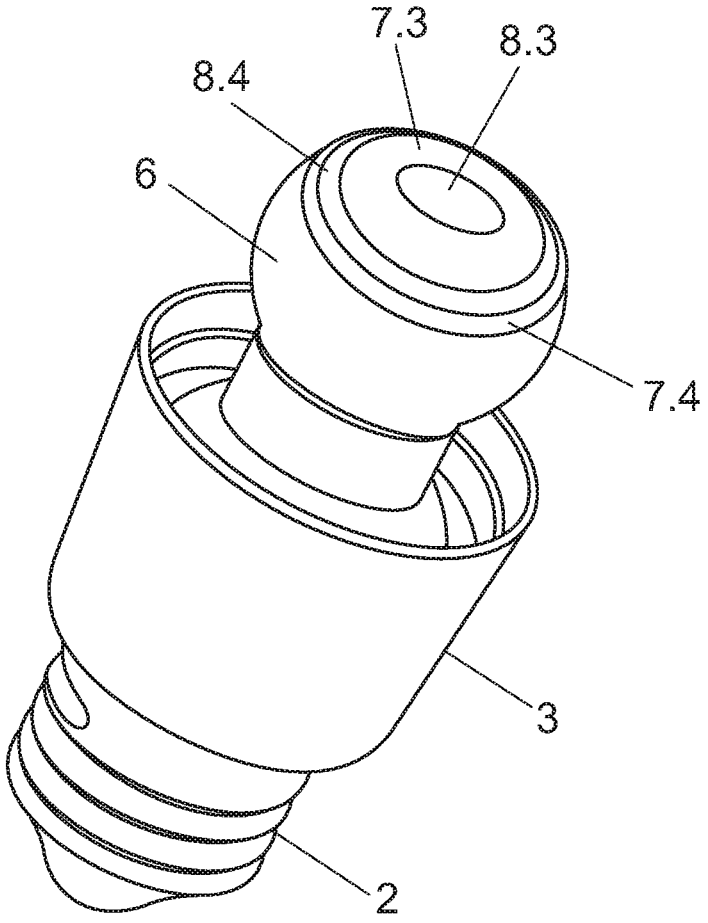
FIG. 7 shows a representation corresponding to FIGS. 2 and 6 of a third exemplary embodiment.

FIG. 7 shows a further variant wherein the reflector cap consists of two parts, wherein the inner part is identified as 7.3 and the outer part as 7.4. Accordingly, there are two openings, specifically an inner opening 8.3 and an outer opening 8.4, which is thus ring-shaped in a similar way to the two reflector cap parts 7.3 and 7.4. Otherwise, the structure corresponds to the first and second exemplary embodiment, that is, FIG. 1 to 5 or 6.

This third exemplary embodiment illustrates that herein, depending on the requirement for evenness of the light intensity distribution and the justifiable effort for the explicit establishment of the geometrical structure, more degrees of freedom can certainly be created than in the first two exemplary embodiments. As will be demonstrated below, the size of the opening 8.3, the width of the first reflector cap part 7.3, the width of the second opening 8.4 and finally the width of the second reflector cap part 7.4 could be varied in order to optimise the light intensity distribution. However, simulations generated for this purpose (on which FIGS. 3 and 4 are also based) become ever more complex with increasing number of the variables or increasingly complex geometry (and with decreasing symmetry). For this reason, with this invention, variants having only one opening are certainly preferred.

In this context, it has also been found that a circular opening such as the opening 8.4 in FIG. 7 alone (without the opening 8.3) achieves somewhat better results than a circular disk-shaped opening such as the opening 8.3 in FIG. 7 alone (that is, without the opening 8.4). Therefore, the simulation of a corresponding example with a ring-shaped opening will be considered in greater detail below.

Figure 8:
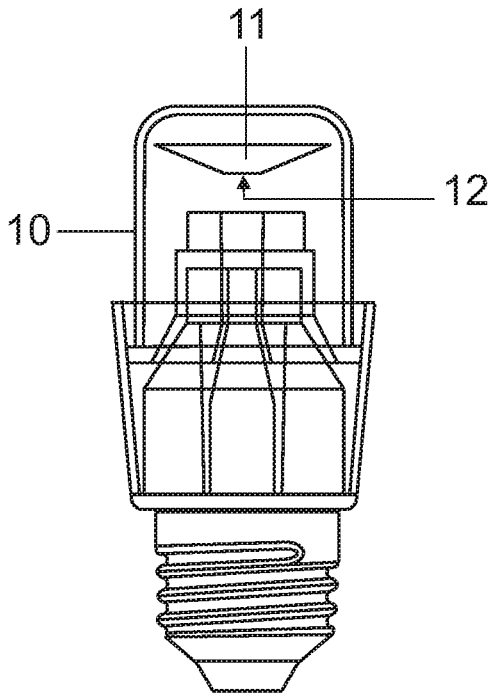
FIG. 8 shows a representation corresponding to FIG. 5 of a fourth exemplary embodiment.

FIG. 8 shows a further, fourth, example and corresponds in the representation largely to FIG. 5. Deviating therefrom, there is herein only one bulb 10 with the diffusely scattering properties of the inner bulb 6 of FIG. 2. This bulb has, in section, an approximately rectangular form with rounded upper corners and, as distinct from the previous exemplary embodiments, a reflector cap 11 is arranged not outside but inside this single bulb 10. In the centre and, in FIG. 8 facing downwardly, the reflector cap 11 has a circular opening 12 and, in section, rises obliquely outwardly therefrom.

The reflector cap 11 has similarities to the reflector cap 7.1 of FIG. 2, although the conicity angle is effectively inverted. In this exemplary embodiment, therefore, the parts of the reflector cap 11 closer to the (in FIG. 8, vertical) longitudinal axis or optical axis are closer than the outer reflector cap parts to a plane defined through the LEDs 5. It could also be said that the reflector cap 11 in FIG. 8 is convex from the perspective of the LEDs (and that of FIG. 2 is concave).

This geometry can be used to reduce the back-reflection of light onto the LEDs 5. However, it is clearly less well suited for a direct mounting externally on an curved bulb. Rather, in this exemplary embodiment, the reflector cap is fastened to the inner wall of the bulb 10 in a manner not shown.

Since this invention also predominantly concerns a simple and also sufficiently isotropic lamp, the solutions described above, in particular with reflector caps in a coating form as in FIGS. 6 and 7 are relatively preferred over that of FIG. 8.

Figure 9:
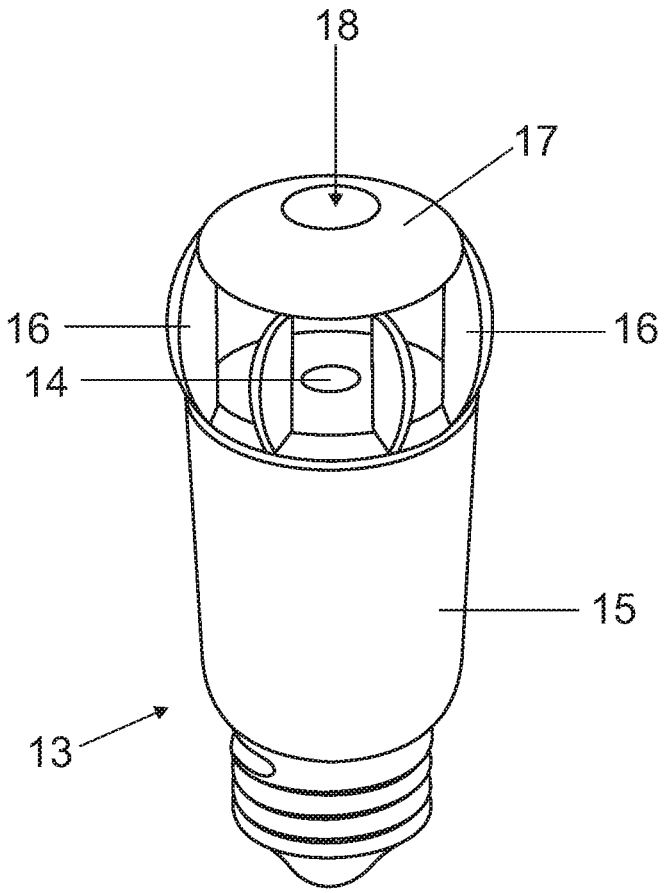
FIG. 9 shows a perspective view.
Figure 10:
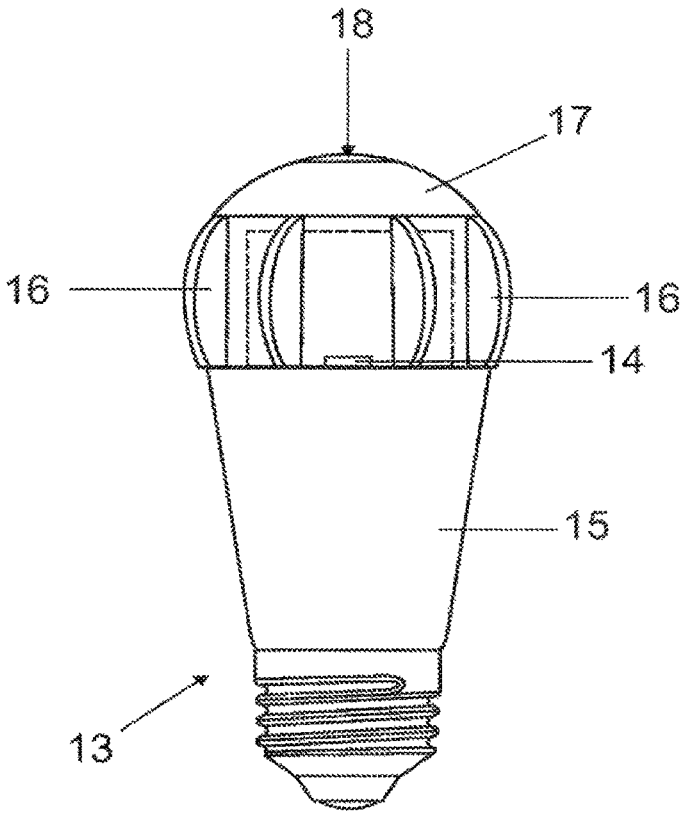
FIG. 10 shows a front view of a fifth exemplary embodiment.

A further exemplary embodiment is shown by FIGS. 9 and 10 in a perspective view (FIG. 9) and as a side view (FIG. 10). Mounted on a holder 13 corresponding to FIG. 1 is an LED chip 14 which is indicated in both FIGS. 9 and 10 and which here for simplicity is not mounted elevated as, for example, in FIG. 8. The holder 13 has a lateral outer surface 15 which gives way to ribs 16 on which a reflector cap 17 is held with a central circular opening 18. The reflector cap 17 and the ribs 16 can be configured in one piece and metallic; this can apply, in principle, also for the lateral surface 15 of the holder 13. Furthermore, the ribs 16 are configured flat, wherein they project radially outwardly in their flatness in order to absorb as little light as possible. Situated within the reflector cap and the ribs 16 is a bulb 19 (merely indicated in FIG. 10), which can actually abut the metal ribs 16 and the metal reflector cap 17.

This exemplary embodiment serves to illustrate that the reflector cap 17 can be configured as part of a cooling apparatus and in this case is connected heat-conductingly to the ribs and via these to the holder housing 15, that is, the holder outer surface 15. In this form, problematic heat input can be effectively distributed and radiated outwardly. Otherwise, the statements regarding the above exemplary embodiments also apply correspondingly here.

The reflector caps shown should have good reflection above all, but can still have a certain degree of transmission. For example, in the examples of FIGS. 6 and 7, they can be sprayed on. Herein, techniques such as, for example, airbrush wherein small gaps between paint particles serve as apertures, can also be used. It has already been mentioned that the details concerning the reflection and transmission are to be regarded as mean values.

Otherwise, the reflector lamp can be used to contain, support or to be formed by decorative or symbolic patterns, images or lettering, provided the previously discussed technical requirements are met. However, such variants make the calculation of the light intensity distribution more difficult (see the description below). It has, however, been found that a true numerical simulation is not necessarily required, but rather while working on this invention, the inventors were able successfully to find intuitive solutions which can simplify the combination with decorative or symbolic elements. It is also possible to change a readily simulatable solution with fine lines which cause little change to the light intensity distribution. Furthermore, the reflector caps need not necessarily be continuous; for example, an opening can extend through a reflector cap or a reflector cap part by means of small "opening channels" and be connected to another opening or the region outside the outermost reflector cap part. This has already been discussed in the introduction.

Figure 11:
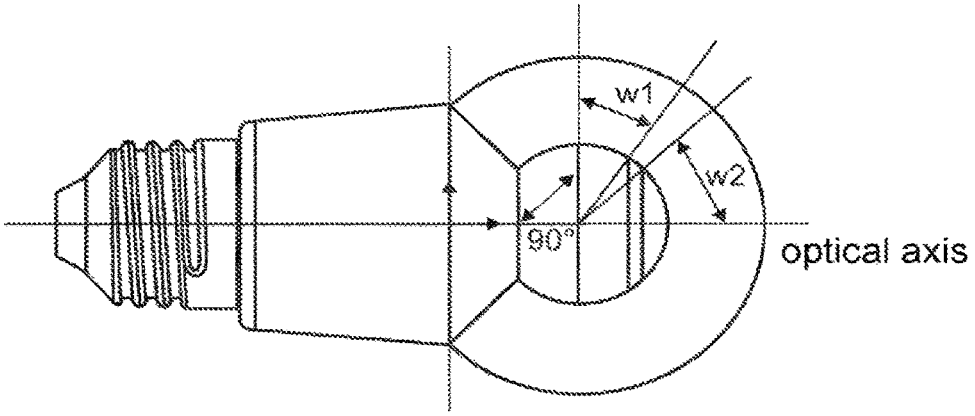
FIG. 11 shows a schematic representation of a sixth exemplary embodiment to explain a simulation calculation.

FIG. 11 shows a further lamp according to the invention which strongly resembles the lamp of FIG. 7, although the circular disk-shaped opening 8.3 is lacking. In FIG. 11, at left, the holder known from FIG. 2 is shown again, wherein in FIG. 11, the transition from its right-hand outer edge in FIG. 11 to the front surface 4 is shown continuously conical. A light kernel is arranged on the front face 4, which is also not labelled in FIG. 11. Also shown are the inner bulb and the outer bulb.

For the purpose of the simulation explained below, the origin of a coordinate system shown in FIG. 11 is placed in the centre of the spherical bulb. It is also stipulated that the reflector cap part corresponding to the reflector cap part 7.4 in FIG. 7 has an angle in this coordinate system of between 90° to the optical axis or the main radiation direction and 90° minus w1 (as drawn), whereas the second reflector cap part (closed toward the right) spans an angle w2, both related to the intersection and a quadrant. The opening thus has a width corresponding to an angle of 90°-w1-w2.

Otherwise, diffuse scattering has been assumed for the inner bulb with an FWHM value of 30° and for the reflector cap, an ideal reflection. On this basis, therefore, a lamp without an opening corresponds to the situation that w1 and w2 together amount to 90° and a lamp without a reflector cap corresponds to the situation that w1 and w2 are both 0°. These extreme cases do not need to be investigated; otherwise in this case, every further combination was simulated in 10° steps, specifically, taking account of the typical radiation characteristic of the light kernel used and the results were evaluated as polar diagrams.

Results similar to FIG. 4 were obtained which show, for example, very marked forward scattering. Then, for example, the opening is too wide. In other results, a polar diagram that is otherwise similar to FIG. 3 splits in the main radiation direction, has a significant indentation there (and looks rather like a butterfly). Then there is insufficient or uneven brightening in the forward direction. For the evaluation, the quantitative details of particular standards, for example, of the Energy Star standard, can also be taken into account.

Figure 12:
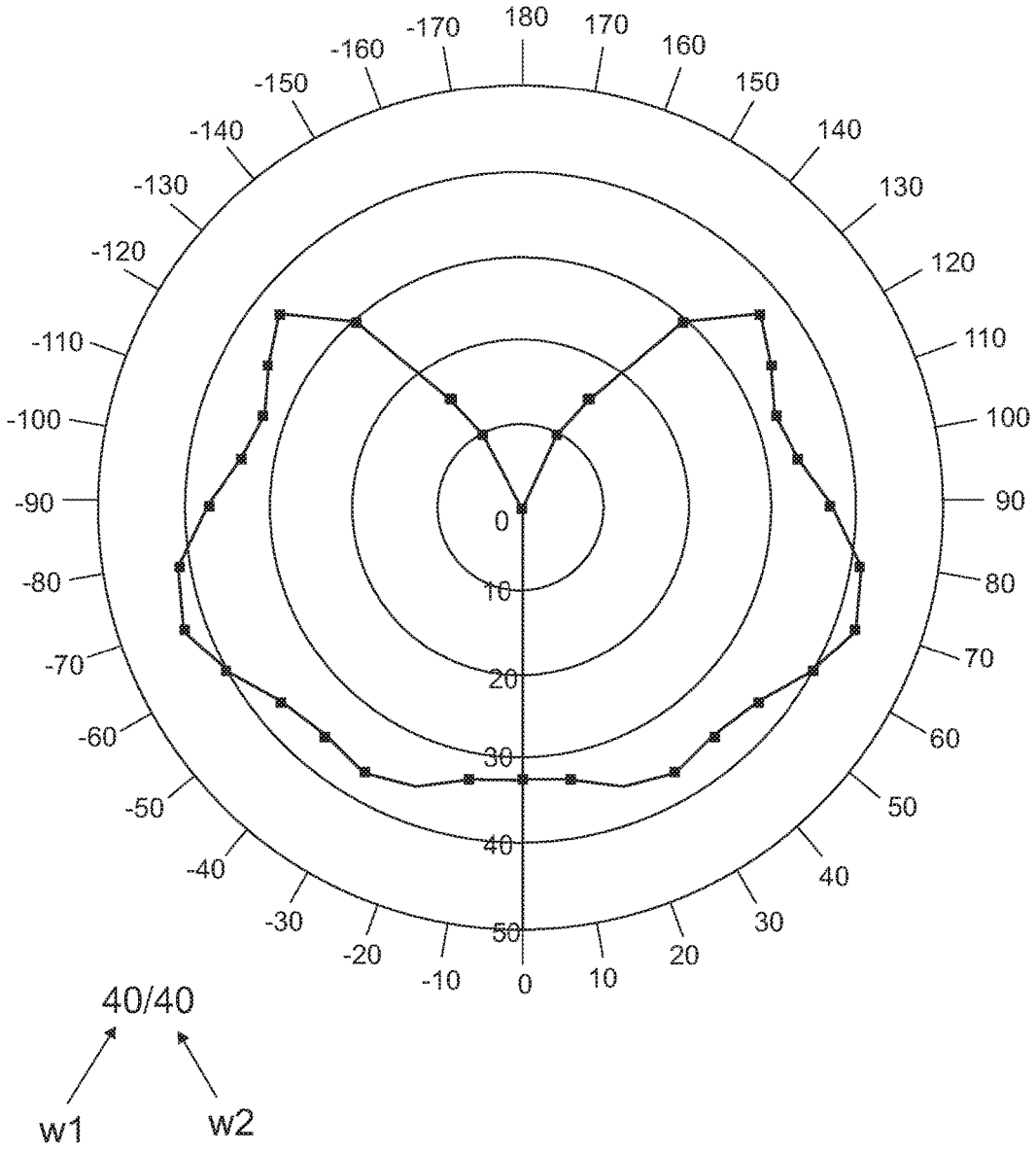
FIG. 12 shows a polar diagram of light intensity distribution in this exemplary embodiment as the result of the simulation.

In this example, favourable combinations of the angle pairs (w1/w2) were found to be: 40/40; 50/30; 60/20. FIG. 11 shows the variant 40/40; FIG. 12 shows the associated polar diagram. This shows, in the entire front half-space, a somewhat even light intensity distribution of between at least 30 and at least 40 units; indeed, this distribution is present at up to almost 140° to the main radiation direction. In this example, the light intensity in the main radiation direction is somewhat weaker than, for example, at 30° or 70° thereto. In the other examples cited, there were small indentations tending to be in the region of 40° to the main radiation direction. A selection can be made here as required.

In principle, in any event, with a simple simulation with a commercial simulation program (in the present case, the commercial program "Light Tools") a variation of decisive parameters can easily be carried out and an optimisation achieved. In this form, by means of the opening in combination with the (herein two-part) reflector cap, significantly better results can be achieved than without the opening or without the reflector cap. With some "practice" this applies even for intuitively selected solutions.

We claim:

1. A lamp comprising:

an optoelectronic light source which has an anisotropic light radiation with a main radiation direction, wherein the radiated light intensity decreases with increasing aperture angle to the main radiation direction;

a reflector cap for reflection of light of the light source radiated in the solid angle, so that the angle of the propagation direction of the reflected light to the main radiation direction increases, said reflector cap more strongly reflects than transmits incident light of the light source;

an opening in the reflector cap; and a diffuser for scattering light passing through the opening;

wherein the reflector cap is present in a larger aperture angle region relative to the main radiation direction and the light source than the opening, so that light reflected by the reflector cap is reflected out of a radiation direction with relatively more intense light radiation into a direction in which the light source radiates light relatively more weakly, and a shadow effect of the reflector cap in the radiation direction with the more intense light radiation is lessened as a result of the opening and the diffuse scattering of the light passing through the opening;

wherein the lamp comprises a bulb surrounding the light source in a solid angle;

wherein the diffuser is configured as a region of the bulb; and wherein the reflector cap is arranged outside a wall of the bulb.

2. The lamp according to claim 1, having a translucent bulb surrounding the light source in a solid angle around the main radiation direction, wherein the diffuser is a diffusely scattering region of the bulb.

3. The lamp according to claim 2, wherein the bulb has a roughened wall, thereby providing diffuse scattering.

4. The lamp according to claim 1, wherein the bulb scatters diffusely with the exception of the reflector cap.

5. The lamp according to claim 1, wherein the diffuse scattering corresponds to an FWHM angle of between 10° and 100°.

6. The lamp according to claim 1, wherein the reflector cap surrounds the opening in relation to a rotation angle about the main radiation direction by at least 75% of the rotation angle.

7. The lamp according to claim 1, wherein the reflector cap is rotationally symmetrical about the main radiation direction.

8. The lamp according to claim 1, wherein the reflector cap is further from the light source at relatively small aperture angles to the main radiation direction in a plane through the light source perpendicular to the main radiation direction of the light source than at relatively large aperture angles.

9. The lamp according to claim 1, wherein an additional part of the reflector cap which covers the main radiation direction is provided in the opening.

10. The lamp according to claim 1, wherein the reflector cap is arranged on a wall of the bulb preferably as a coating.

11. The lamp according to claim 1, wherein the reflector cap comprises a diffusely reflecting layer and permits no transmission.

12. The lamp according to claim 1, wherein a second bulb is provided outside the aforementioned bulb and the second bulb is clearly transparent.

13. The lamp according to claim 1, wherein the reflector cap is part of a cooling apparatus and is heat-conductingly connected to a holder of the lamp holding the light source, in particular, in the form of cooling ribs.

* * * * *